United States Patent [19]

Watanabe et al.

[11] 4,399,213

[45] Aug. 16, 1983

[54] SILVER HALIDE PHOTOSENSITIVE PHOTOGRAPHIC MATERIAL

[75] Inventors: Yoshikazu Watanabe, Hino; Motoaki Tanaka, Hachioji, both of Japan

[73] Assignee: Konishiroku Photo Industry Co., Ltd., Tokyo, Japan

[21] Appl. No.: 312,136

[22] Filed: Oct. 16, 1981

Related U.S. Application Data

[63] Continuation of Ser. No. 145,501, Apr. 29, 1980, abandoned, which is a continuation of Ser. No. 791, Jan. 3, 1979, abandoned.

[30] Foreign Application Priority Data

Jan. 9, 1978 [JP] Japan ..... 53-1442

[51] Int. Cl.[3] ..... G03C 1/78

[52] U.S. Cl. ..... 430/523; 430/531; 430/539; 430/941; 430/950

[58] Field of Search ..... 430/523, 539, 273, 950, 430/941, 531

[56] References Cited

U.S. PATENT DOCUMENTS

| | | | |
|---|---|---|---|
| 3,411,907 | 11/1968 | Whitmore et al. | 430/564 |
| 3,489,567 | 1/1970 | McGraw | 430/531 |
| 3,591,379 | 7/1971 | Plakunov | 430/502 |
| 3,656,954 | 4/1972 | Thiers et al. | 430/536 |
| 3,920,456 | 11/1975 | Nittel et al. | 430/523 |
| 4,013,696 | 3/1977 | Babbitt et al. | 430/528 |
| 4,021,244 | 5/1977 | Nagatomo et al. | 430/539 |
| 4,069,053 | 1/1978 | Mayama et al. | 430/950 |
| 4,201,586 | 5/1980 | Hori et al. | 430/950 |

OTHER PUBLICATIONS

Research Disclosure, Item No. 16559, p. 20, Jan. 1978.

*Primary Examiner*—J. Travis Brown

*Attorney, Agent, or Firm*—Jordan B. Bierman; Linda Bierman

[57] ABSTRACT

A silver halide photosensitive material comprising a support, a silver halide photosensitive layer, and a protective layer formed on said support. The protective layer is essentially composed on a plurality of non-photosensitive hydrophilic colloidal layers at least one of which contains oil particles. The outermost layer of the hydrophilic colloidal layers contains a matting agent in the form of colloidal particles and has a thickness of not more than one fourth of the average size of the matting agent particles and wherein the density of the oil particles in said outermost layer does not exceed 0.2 by volume of the binder, and that of the oil particles in the protective layers other than the outermost layer is in the range of 0.1 to 0.8.

7 Claims, No Drawings

SILVER HALIDE PHOTOSENSITIVE PHOTOGRAPHIC MATERIAL

The present application is a Continuation of Application 145,501, filed Apr. 29, 1980, now abandoned, which is a Continuation of Application Ser. No. 000,701, filed Jan. 3, 1979, now abandoned, which, in turn, claims the priority of Japanese Application 1442/78, filed Jan. 9, 1978.

This invention relates to a silver halide photographic photosensitive material and more particularly, to a silver halide photosensitive material with improved surface characteristics.

As is well known in the art, silver halide photographic photosensitive materials are generally comprised of a support, at least one silver halide photosensitive layer formed on the support, and a surface layer or protective layer formed on the photosensitive layer and containing as binder a hydrophilic colloidal substance typical of which is gelatin. The photographic photosensitive materials of this type increase in surface adhesiveness or tackiness under high temperature conditions, and particularly under high temperature and high humidity conditions, and thus tend to adhere to or block when contacted with any other material or each other. The adhesiveness or blocking tendency is irresistibly developed during production, use, processing or storage of the photosensitive material, presenting a number of disadvantages. In order to overcome the disadvantages, there is known a method in which the adhesiveness is improved by dispersing in the protective layer the fine particles of an inorganic material such as silica, titanium dioxide, magnesium oxide, magnesium carbonate or the like or of an organic material such as poly(methyl methacrylate), cellulose acetate propionate or the like thereby matting the surface of the protective layer. However, the photosensitive material which has been increased in degree of the matting to a satisfactory extent by application of the method is disadvantageous in that the image obtained by photographic processing is impaired in transparency or graininess. To mitigate the impairment, there is an attempt to reduce the amount of a binder relative to that of the matting agent. However, it has been found that there is another disadvantage that the photosensitive material obtained by such reduction is lowered in physical strength or brittleness so that it is apt to break when wound up quickly under low humidity conditions and especially when wound up at high speed by the use of a motor-driven camera.

These disadvantages present serious problems in the photographic art but it has been considered difficult to solve such problems on both the adhesiveness and the brittleness of the material.

It is accordingly an object of the present invention to provide a silver halide photographic photosensitive material which offers no problem of the adhesiveness and brittleness.

It is another object of the present invention to provide a silver halide photographic photosensitive material which has a relatively high content of a matting agent and which is less devitrified and deteriorated in image after a photographic treatment of the material.

The above objects can be achieved by a silver halide photographic photosensitive material which comprises a support, and a silver halide photosensitive layer and a protective layer formed on the support in this order, the protective layer being essentially composed of a plurality of non-photosensitive hydrophilic colloidal layers, at least one of which contains oil particles, the outermost layer of the hydrophilic colloidal layers, containing a matting agent in the form of colloidal particles and having a thickness not more than $\frac{1}{4}$ times, and preferably 1/10 to 1/5 times, as small as an average size of the matting agent particles.

The term "thickness of the protective layer" as used herein is intended to mean a total thickness of layers composed of a hydrophilic colloidal binder material and oil particles, not including that of the matting particles which are irregularly projecting from the outermost layer surface.

The matting agent which is used in the form of particles in the practice of the invention is, for example, an inorganic material such as titanium dioxide, calcium carbonate or the like, or an organic material such as poly(methyl methacrylate) or cellulose acetate propionate. Alternatively, the matting agent may be porous particles of an alkali-soluble copolymer composed of acrylic acid and methyl acrylate as described in Japanese Pre-Exam. Patent Publication No. 51-135958. The particles size is preferably in the range of about $0.1\mu$–$20\mu$ and most preferably $0.5$–$10\mu$. In the most preferred embodiment of the present invention, the matting agent is poly(methyl methacrylate) or silica in the form of particles with an average size of $1$–$8\mu$.

In practice, the protective layer can be provided not only on the silver halide photosensitive layer but also on a surface on which the silver halide photosensitive layer is not formed. For instance, when the silver halide photosensitive layers are formed on the respective sides of a support, the protective layers may be provided on both sides. On the other hand, when a silver halide photosensitive layer is formed on a support only on one side thereof, the protective layer may be provided on a sub layer or a support per se at the photosensitive layer-free side where no silver halide layer is formed. The thickness of the protective layer is generally in the range of $0.1$–$5\mu$ and preferably $0.3$–$3\mu$.

The thickness of the outermost layer in the practice of the invention depends on the type of binder, particle size of the matting particles and an intended level of matting, but is generally in the range of below $3\mu$ and preferably below $1\mu$.

The hydrophilic material used as a binder of the protective layer includes, for example, gelatin, modified gelatin such as phthalated gelatin, malonated gelatin, and the like. Part or all of gelatin or its derivatives may be replaced by albumin, agar-agar, gum arabic, alginic acid, casein, partially hydrolyzed cellulose derivatives, polyvinyl alcohol, partially hydrolyzed polyvinyl acetate, polyacrylic acid, polyacrylamide, imidated polyacrylamide, polyvinylpyrrolidone, and copolymers of the above-mentioned vinyl compounds.

The oil particles suitable for the practice of the invention are an independent phase of oil finely dispersed in the form of discrete liquid droplets in the binder composed substantially of the hydrophilic colloidal substance. The oil particles have such a nature that they are substantially insoluble in water.

The oil particles have generally a diameter in the range of $0.01$–$20\mu$ and are preferred to be in the range of $0.1$–$10\mu$ as expressed by an average size.

Examples of the material useful for such oil particles include so-called lubricants such as organic high melting compounds ordinarily employed for the dispersion of a photographic coupler such as disclosed, for example, in U.S. Pat. Nos. 2,322,027, 2,801,170, 2,801,171, 2,272,191 and 2,304,940, sodium higher alkylsulfates such as described, for example, in U.S. Pat. Nos. 2,882,157, 3,121,060 and 3,850,640 and Japanese Pre-Exam Patent Publication No. 51-141623, esters of higher fatty acids and higher alcohols (so-called waxes), high molecular weight polyethylene glycol, higher alkyl phosphates, silicone-base compounds, and the like.

Alternatively, any materials which are solid at a normal temperature but are turned liquid when added to and contained in the hydrophilic colloidal layer or when mixed with various types of photographic additives are usable as the oil particles. The materials of the above type are generally those which have melting points of below 50° C.

The organic high melting compounds mentioned above are those which have preferably a melting point above 180° C. and include, for example, diethyl adipate, dibutyl adipate, diisobutyl adipate, di-n-hexyl adipate, dioctyl adipate, dicyclohexyl azelate, di-2-ethylhexyl azelate, dioctyl sebacate, diisooctyl sebacate, dibutyl succinate, octyl stearate, dibenzyl phthalate, tri-o-cresyl phosphate, diphenyl-mono-p-tert-butylphenyl phosphate, monophenyl-di-o-chlorophenyl phosphate, monobutyl-di-octyl phosphate, 2,4-di-n-amylphenol, 2,4-di-tert-amylphenol, 4-n-nonylphenol, 2-methyl-4-n-octylphenol, N,N-diethylcaprylamide, N,N-diethylaurylamide, glycerol tripropionate, glycerol tributylate, glycerol monolatatediacetate, tributyl citrate, acetyltriethyl citrate, di-2-ethylhexyl adipate, dioctyl sebacate, di-isooctyl acetate, diethylene glycol dibenzoate, dipropylene glycol dibenzoate, triethyl citrate, tri(2-ethylhexyl)citrate, acetyltri-n-butyl citrate, di(isodecyl)-4,5-epoxytetrahydrophthalate, oligovinyl ethyl ether, dibutyl fumarate, polyethylene oxide ($n>16$), glycerol tributyrate, ethylene glycol dipropionate, di(2-ethylhexyl)isophthalate, butyl laurate, tri(2-ethylhexyl)-phosphate, triphenyl phosphate, tricresyl phosphate, silicone oil, dimethyl phthalate, diethyl phthalate, dipropyl phthalate, dibutyl phthalate, diiooctyl phthalate, diamyl phthalate, di-n-octyl phthalate, diamylnaphthalene, triamylnaphthalene, monocaprin, monolaurin, monomyristin, monopalmitin, monostearin, monoolein, dicaprin, dilaurin, dimyristin, dipalmitin, distearin, diolein, 1-stearo-2-palmitin, 1-palmito-3-stearin, 1-palmito-2-stearin, triacetin, tricaprin, trilaurin, trimyristin, tripalmitin, tristearin, triolein, tripetroselin, trierucin, triricinolcin, linoleodistearin, linoleodilinolenin, oleodieruein, linoleodierucin, palmitooleolinolenin, paraffin, drying oils such as linseed oil, soybean oil, perilla oil, tung oil, hempseed oil, kaya oil, walnut oil, soy sauce oil, poppy seed oil, sunflower oil, catalpa oil, arrowhead oil, safflower oil and the like, semi-drying oils such as cotton seed oil, corn oil, sesame oil, rape oil, rice bran oil, croton oil, mustard oil, capoc oil, dehydrated castor oil and the like, non-drying oils such as peanut oil, olive oil, tsubaki oil, sasanqua oil, tea oil, castor oil, hydrogenated castor oil, almond oil, ben oil, chaulmoogra oil and the like.

The organic compounds of high melting point may further include those expressed by the following formulae:

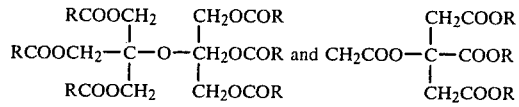

(in which each R represents an alkyl group containing 1 to 8 carbon atoms).

Of these, the esters of glutaric acid, adipic acid, phthalic acid, sebacic acid, succinic acid, maleic acid, fumaric acid, azelaic acid, isophthalic acid, terephthalic acid, and phosphoric acid, esters of glycerine, paraffin, and fluorinated paraffin are favorably usable since they do not offer any adverse effect on the photosensitive material and are readily available and easy to handle due to their excellent chemical stability. Most preferable organic high melting compounds are tricresyl phosphate, triphenyl phosphate, dibutyl phthalate, di-n-octyl phthalate, di-2-ethylhexyl phthalate, glycerol tributyrate, glycerol tripropionate, dioctyl sebacate, paraffin, fluorinated paraffin, and silicone oil.

The oil particles can be formed in the protective layer by any of known techniques typical of which is a method which follows. For example, one or more of the above-indicated organic high melting compounds are mixed for dissolution, if necessary, with photographic additives which will be described in detail and then dissolved, if necessary, in a solvent of low melting point such as methyl acetate, ethyl acetate, propyl acetate, butyl acetate, butyl propionate, cyclohexanol, diethylene glycol monoacetate, nitromethane, carbon tetrachloride, chloroform, cyclohexane tetrahydrofuran, methyl alcohol, ethyl alcohol, propyl alcohol, fluorinated alcohol, acetonitrile, dimethylformamide, dioxane, acetone, methyl ethyl ketone, methyl isobutyl ketone or the like. These solvents of low melting point may be used singly or in combination. Then, the solution is mixed with an aqueous solution of a hydrophilic colloidal substance such as gelatin in which there is contained an anionic active agent such as alkylbenzenesulfonic acid or alkylnaphthalenesulfonic acid and/or a nonionic active agent such as sorbitan sesquioleic acid ester or sorbitan monolauric acid ester, and is then emulsified and dispersed in a suitable means such as a high speed rotary mixer, a colloid mill or an ultrasonic dispersing device. The resulting dispersion is added to a coating solution which contains a hydrophilic colloidal material and finally applied to a silver halide photosensitive layer formed on a support. With certain types of compounds capable of forming the oil particles, the compound is dissolved in an organic solvent of low melting point as indicated above and the resulting solution may be added directly to a hydrophilic colloidal material-containing coating solution to be used to form the protective layer.

If the solution is applied and dried, the organic solvent of low melting point will evaporate and thus hardly remain in the binder.

In general, the oil particles can be contained in the outermost layer of the protective layer and/or the layers other than the outermost layer. In this connection, however, if the density of the oil particles in the outermost layer of the protective layer is very high, the oil particles dispersed in the binder may be combined together and ooze or bleed from the outer surface in the state of a perspiration particularly under high temperature and high humidity conditions, thus rendering the surface smeary. To cite an extreme case, the photosensitive material may become opaque or cloudy on the surface thereof by the perspiration phenomenon. Accordingly, the density of the oil particles in the outermost layer is preferred to be in the range not exceeding 0.2 by volume of the binder. The density of the oil particles in the protective layers other than the outermost layer is preferably in the range of above 0.1 and most preferably in the range of 0.2–0.8.

The term "density of oil particles" used herein is intended to imply a ratio of a total capacity or volume of the oil particles added to the non-photosensitive hydrophilic colloidal layers to a total volume of the binder contained in the colloidal layers.

It has been unexpectedly found that when the oil particles are contained in at least one of the non-photosensitive hydrophilic colloidal layers of the protective layer, the brittleness of the material as frequently experienced in the prior art material when the content of binder in the matting agent-containing layer is reduced is improved to an extent with a reduced degree of divitrification and an increased efficiency of addition of the matting agent.

The protective layer may further include a slipping agent. Examples of such slipping agent include sodium higher alkylsulfates, higher fatty acid and higher alcohol esters, carbowax, higher alkyl phosphates, silicone-base compounds and the like. Further, the compounds described in U.S. Pat. Nos. 2,882,157, 3,121,060 and 3,850,640 and also in Japanese Pre-Exam. Patent Publication No. 51-141623 are particularly effective when used singly or in combination. These patents will be incorporated herein by reference.

In the practice of the invention, the adhering or blocking tendency of the material is remarkably improved when an organic fluoro compound is added to at least one of the protective layers.

The organic fluoro compounds useful in the present invention include chain or cyclic compounds which contain at least three fluorine atoms and at least three carbon atoms and may be of any types including cation, nonion, anion and betaine.

Typical organic fluoro compounds useful in the present invention are those as described in, for example, U.S. Pat. Nos. 3,589,906, 3,666,478, 3,754,924, 3,775,126 and 3,850,640, British Pat. Nos. 1,330,356 and Japanese Patent Application No. 50-21391, which will be incorporated herein by reference.

Examples of such organic fluoro compounds are shown below.

(1) $CF_3—(CF_2)_6—COONH_4$ (2) $CF_3(CF_2)_9(CH_2)_{10}COOH$ (3) $CF_3(CF_2)_5—(CH_2)_{10}—COONa$ (4) $Cl—CF_2—(\underset{\underset{Cl}{|}}{CF}—CF_2)_4COOH$ (5) $H—(CF_2)_{10}—COONa$ (6) $HOOC—(CF_2—\underset{\underset{Cl}{|}}{CF})_4COOH$ (7) $Cl(CF_2—\underset{\underset{Cl}{|}}{CF})_3CF_2—COOK$ (8) $CF_3—(CF_2)_6—CH{=}CH—(CH_2)_3COONa$ (9) $CF_3—(CF_2)_3—\underset{\underset{CF_3}{|}}{CF}—(CH_2)_{10}—COONa$

(10) 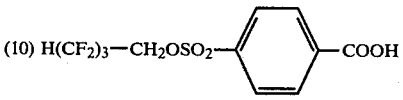

(11) $CF_3(CF_2)_7—CO—\underset{\underset{CH_3}{|}}{N}—(CH_2)_2—COONa$

(12) $Cl(CF_2)_6—COONa$

(13) $CF_3—(CF_2)_3—CH_2CH_2—SO_2—\underset{\underset{C_2H_5}{|}}{N}—CH_2—COONa$

(14) $CF_3(CF_2)_7—SO_2—\underset{\underset{C_2H_5}{|}}{N}—CH_2—COOK$

(15) $CF_3(CF_2)_7—SO_2—\underset{\underset{C_3H_7}{|}}{N}—CH_2—COOK$

(16) $CF_3(CF_2)_6—CO—\underset{\underset{C_2H_5}{|}}{N}—(CH_2)_2—SO_3K$

(17) 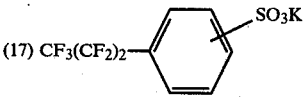

($SO_3K$ may be positioned at the o-, m- or/and p-position.)

(18) 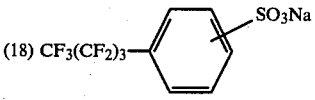

($SO_3Na$ may be positioned at the o-, m- or/and p-position.)

(19) $CF_3(CF_2)_7—SO_3K$

(20) $CF_3(CF_2)_{11}—CH_2—OSO_3Na$

(21) $CF_3(CF_2)_6—COO—(CH_2)_3—SO_3Na$

(22) $H(CF_2)_6—CH_2—C—(CH_2)_3—SO_3Na$

(23) $NaO_3S—\overset{\overset{CH_2—COOCH_2—(CF_2)_6—H}{|}}{CH}—COOCH_2—(CF_2)_6—H$

(24) $NaO_3S—\overset{\overset{CH_2—COOCH_2—(CF_2CF_2)_3H}{|}}{CH}—COOCH_2—(CF_2CF_2)_2H$

(25) $\underset{\underset{CHCOOK}{|}}{CHCO}(OCH_2CH_2)_4.\underset{\underset{CH_2COOCH_2CF_2CF_2H}{|}}{OCHCOOCH_2CF_2CF_2H}$

(26) $C_{16}H_{33}—\underset{\underset{SO_3Na}{|}}{CH}—COOCH_2—CF_3$

(27) $C_{16}H_{33}—\underset{\underset{SO_3Na}{|}}{CH}—CONHCH_2—(CF_2)_2H$

-continued

(28) $CF_3(CF_3)_7-SO_2-NHCH_2CH_2-\overset{\oplus}{N}(CH_2CH_3)_2-CH_2-COO^{\ominus}$

(29) $CF_3-C(C_2H_5)(C_2F_5)-C(CF_3)(CH_2O(CH_2CH_2O)_7H)-CHF-CH_3$

(30) $CF_3-C(C_2F_5)(C_2F_5)-C(CF_3)(COO(CH_2CH_2O)_4H)-CHF-CF_3$

(31) $CF_3-C(C_2F_5)(C_2F_5)-C(CF_3)(COONa)-CF_3$

(32) $CF_3-C(C_2F_5)(C_2F_5)-CH(CF_3)-CF(CF_3)-COONa$

(33) $CF_3-(CF_2)_7-SO_2-N(C_2H_5)-(CH_2)_2-O-(CH_2CH_2O)_{20}H$

(34) $CF_3-(CF_2)-COO-(CH_2CH_2-O-)CH_3$

(35) $H-(CF_2)_{16}-CH_2OH$

(36) $H-(CF_2)_6-CH_2OH$

(37) $CF_3(CF_2)_6-COO(CH_2-CH(CH_3)-O-)_4(CH_2CH_2O)_{20}H$

(38) $CF_3(CF_2)_6-COO(CH_2-CH(CH)-O-)_3(CH_2-CH_2-O-)_{10}$

(39) $CF_3-(CF_2)_7-SO_2NH(CH_2)_3-\overset{\oplus}{N}(CH_3)_3(CH_2)_4-CH_3.I^{\ominus}$

(40) $CF_3(CF_2)_6-CO-NHCH_2CH_2-\overset{\oplus}{N}$ 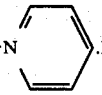 $.I^{\ominus}$

(41) $CF_3(CF_2)_6-CONH(CH_2)_3-\overset{\oplus}{N}(CH_3)_2-CH_2CH_2COO^{\ominus}$

(42) $CF_3-(CF_2)_7-SO_2-N(CH_3)-CH_2CH_2OSO_3H$

(43) 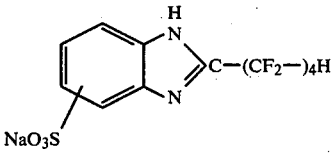

($SO_3Na$ may be positioned at the 4- or/and 5-position.)

-continued

(44) $CF_{17}SO_2-N(C_2H_5)-CH_2-CH_2-O-P(=O)(OH)-OH$

(45) $H-(CF_2)-O-P(=O)(ONa)-ONa$

(46) $CF_3-(CF_2)_{12}-COO-(CH_2CH_2O-)_{20}H$

(47) $CF_3-(CF_2)_6-CO-N(CH_3)-(CH_2)_2-O-(CH_2CH_2O-)H$

(48) $F(CF(CF_3)-CF_2O)_2-CF(CF_3)CONH(CH_2)_3N(CH_3)_2 \rightarrow O$

(49) $(CH_3COO)_2CH(CF_2)CF_3$

(50) 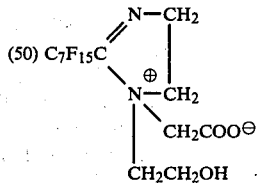

(51) 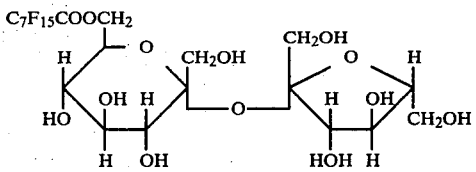

(52) 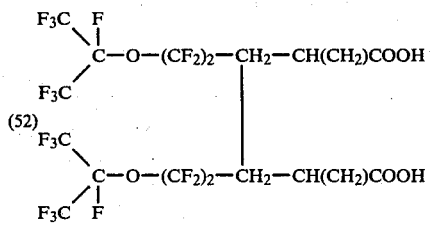

(53) $CF_3-C(C_2F_5)(C_2F_5)-CH(CF_3)-CF(CF_3)-CONH(CH_2)_3\overset{\oplus}{N}(CH_3)_3.Cl^{\ominus}$

(54) $CF_3-C(C_2F_5)(C_2F_5)-OH-CF(CF_3)CONH(CH_2)_2\overset{\oplus}{N}$ 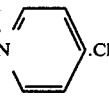 $.Cl^{\ominus}$

(55) $CF_3-C(C_2F_5)(C_2F_5)-C(CF_3)(SO_3Na)-CHF-CF_3$

(56) $CF_3-C(C_2F_5)(C_2F_5)-CH(CF_3)-CF(CF_3)-SO_3Na$

-continued

(57) 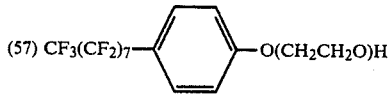

(58) $H(CF_2)_6—CH_2O—(CH_2CH_2)_{10}H$
(59) $H—(CF_2)_6—CH_2O—(CH_2CH_2O)_{20}H$
(60) $H—(CF_2)_4—CH_2O—(CH_2CH_2O)_5H$

(61) $H—(CF_2)_6—CH_2O—(CH_2CH(OH)CH_2O)_5H$

(62) $H—(CF_2)_6—CH_2O—(CH_2CH(OH)CH_2O)_2—(CH_2CH_2O)_5H$

Of these, the anionic organic fluorine surface active agents are most preferable as the fluoro compound. The amount of the organic fluoro compound is in the range of 0.1–500 mg, and preferably 1–200 mg, per $m^2$ of the protective layer.

A variety of photographic additives may be added to the oil particles. Though the additives may be of the hydrophilic or oleophilic nature, it is preferable to use oleophilic ones. As typical of such additives, there may be mentioned an oil-soluble coupler, ultraviolet absorber, development inhibitor-releasing compound (so-called DIR compound), anti-stain agent such as hydroquinone derivatives, fading resistant, anti-oxidant and the like.

The non-photosensitive hydrophilic colloidal layers constituting the protective layer may contain colloidal silver dispersed therein. Furthermore, the colloidal layers may contain fine particles of silver halide, which does not substantially take part in or suffer from development, as described, for example, in U.S. Pat. Nos. 3,050,391, 3,140,179 and 3,523,022.

The non-photosensitive hydrophilic colloidal layers may be hardened by the use of any of known hardening agents. Examples of such hardening agent include ketone compounds such as diacetyl, dichloropentanedione and the like, bis(2-chloroethylurea), 2-hydroxy-4,6-dichloro-1,3,5-triazine, compounds containing a reactive halogen as described in U.S. Pat. Nos. 3,288,775 and 2,732,303, and British Pat. Nos. 974,723 and 1,167,207, divinyl sulfone, 5-acetyl-1,3-diacryloylhexahydro-1,3,5-triazine, and compounds as described in U.S. Pat. Nos. 3,635,718 and 3,232,763, British Pat. No. 994,869, and U.S. Pat. Nos. 2,732,316, 2,586,168, 3,103,437, 3,117,280, 2,983,611, 2,725,294, 2,725,295, 3,100,704, 3,091,537, 3,321,313 and 3,543,292.

For the formation of the hydrophilic colloidal layers, surface active agents which are used singly or in combination may be added to a coating solution. These surface active agents serve as a coating aid or serve to improve the emulsifiability or dispersibility as well as sensitometric characteristics, and also as an anti-static agent or an anti-adhesion agent. These surface active agents include natural surfac active agents such as saponin, nonionic active agents such as alkylene oxide type compounds, glycerine type compounds, glycidol type compounds and the like, cationic active agents such as higher alkylamines, quaternary ammonium salts, pyridine, other hetero compounds, phosphonium salts and sulfonium salts, anionic active agents such as carboxylic acids, sulfonic acid, phosphoric acid, compounds containing acidic groups such as sulfate, phosphate and the like, and ampholytic active agents such as amino acids, aminosulfonic acids, sulfate or phosphate of amyl alcohol and the like.

Typical examples of the surface active agents usable for the above purpose are those as described in U.S. Pat. Nos. 2,271,623, 2,240,472, 2,288,226, 2,739,891, 3,068,101, 3,158,484, 3,201,253, 3,210,191, 3,294,540, 3,441,413, 3,442,654, 3,475,174 and 3,545,974, West German OLS No. 1,942,665, and British Pat. Nos. 1,077,317 and 1,198,450. The non-photosensitive hydrophilic colloidal layers may further contain other various additives for photography.

As described hereinbefore, the photosensitive material according to the invention is comprised of a support and at least one silver halide photosensitive layer formed on the support. These silver halide photosensitive layer and support, and other auxiliary layers (anti-halation layer, filter layer, intermediate layer and sub layer) provided as required, may be any of known ones.

The silver halide used to form the photosensitive layer of the material is generally in the form of particles of a silver halide dispersed in a hydrophilic colloid. Examples of the silver halide include silver bromide, silver chlorobromide, silver bromoiodide, and silver chlorobromoiodide. These silver halides can be produced by various known methods including not only an ammonia method, a neutral method and an acidic method but also a so-called conversion method and a simultaneous mixing method as described in British Pat. No. 635,841 and U.S. Pat. No. 3,622,318.

As the hydrophilic colloid for dispersing the silver halide therein, there can be used the binder to form the non-photosensitive hydrophilic colloidal layers.

The silver halide emulsion can be chemically sensitized by any usual technique. If necessary, the emulsion may be spectrally sensitized or hypersensitized by using, singly or in combination, cyanine dyes such as cyanine, merocyanine, carbocyanine or styryl dyes in combination with the cyanine dyes.

To the photographic emulsion may be added a variety of compounds so as to prevent reduction of sensitivity or occurrence of fogging during the production process, storage or processing of the photosensitive material. For the above purpose, there have been known a number of compounds including 4-hydroxy-6-methyl-1,3,3a,7-tetraazaindene, 3-methylbenzothiazole, 1-phenyl-5-mercaptotetrazole, other heterocyclic compounds, mercury-containing compounds, mercapto compounds, metal salts and the like.

The color photographic photosensitive material according to the invention may include couplers as indicated below.

Open-chain keto-methylene compounds are known to be useful as yellow couplers. In the practice of the invention, benzoylacetoanilide-type couplers and pivaloylacetoanilide-type yellow couplers which have been now widely used can be employed. In addition, yellow couplers of the two-equivalent type in which the carbon atom at the coupling position has a substituent capable of freeing therefrom upon coupling reaction are conveniently usable in the present invention. Examples of such couplers are those as described in U.S. Pat. Nos. 2,875,057, 3,265,506, 3,664,841, 3,408,194, 3,447,928, 3,277,155 and 3,415,652, Japanese Post-Exam Patent Publication No. 49-13576, and Japanese Pre-Exam Patent Publication Nos. 48-29432, 48-66834, 49-16736, 49-122335, 50-28834 and 50-132926.

Usable magenta couplers are compounds of pyrazolone-type, pyrazolotriazole-type, pyrazolinobenzimidazole-type, and indazolone-type. The pyrazolone-type magenta couplers are those as described in U.S. Pat. Nos. 2,600,788, 3,062,653, 3,127,269, 3,311,476, 3,419,391, 3,519,429, 3,558,318, 3,684,514 and 3,888,680, Japanese Pre-Exam Patent Publication Nos. 49-29639, 49-111631, 49-129538, 50-13041 and 51-105820, and Japanese Patent Application Nos. 50-134470 and 50-156327. The pyrazolotriazole-type magenta couplers are those as described in U.S. Pat. No. 3,061,432, German Pat. No. 2,156,111 and Japanese Post-Exam Patent Publication No. 46-60479. The indazolone-type magenta couplers are those as described in Belgian Pat. No. 769,116. The pyrazolinobenzimidazole-type magenta couplers are those as described in U.S. Pat. No. 3,061,432, German Pat. No. 2,156,111 and Japanese Post-Exam Patent Publication No. 46-60479. The indazolone-type magenta couplers are those as described in Belgian Pat. No. 769,116.

Cyan couplers suitable for the practice of the invention are phenol or naphthanol derivatives. Examples of the cyan couplers are those as described, for example, in U.S. Pat. Nos. 2,423,730, 2,474,293, 2,801,171, 2,895,826, 3,476,563, 3,737,316, 3,758,808 and 3,839,044, and Japanese Pre-Exam Patent Publication Nos. 47-3742, 50-10136, 50-25228, 50-112038, 50-117422 and 50-130441. The patents and patent publications mentioned hereinabove will be incorporated herein by reference.

Aside from the above-indicated couplers, colored magenta couplers or colored cyan couplers are conveniently usable in the present invention.

In practice, the silver halide photosensitive layer may be contained with a so-called DIR compound. Further, the silver halide photosensitive layer may be optionally contained with any photographic additives such as a color-fading resistant, an anti-stain agent and the like.

The support on which formed are the non-photosensitive hydrophilic colloidal layers, the silver halide photosensitive layer and other auxiliary layers is, for example, a film of a cellulose ester such as cellulose nitrate, cellulose acetate or the like, a polyester film such as polyethylene terephthalate, a polyvinyl acetal film, a polyvinyl chloride film, a polystyrene film, a polycarbonate film, baryta paper, polyethylene-laminated paper or the like.

The coating method for the protective layer, silver halide photosensitive layer and other layers of the photosensitive material should properly be selected to ensure the uniform quality and high productivity of the product. A suitable coating method can be selected from, for example, dip coating, double roll coating, air knife coating, extrusion coating and curtain coating. Of these, the extrusion coating and curtain coating are especially useful since they enable two or more layers to be coated simultaneously. The coating speed may be arbitrarily determined but is preferred to be in the range above 30 m/min in view of productivity.

If it is necessary to use a substance or agent such as a hardening agent which is apt to gel prior to application due to its high reactivity when added to a coating solution, it is preferable to mix such agent with the coating solution immediately before the application by the use of a static mixer.

The photosensitive material according to the invention is suitably applicable for monochromatic, X-ray, printing, micro, electron-beam, infrared ray, color and the like recordings.

The present invention will be particularly illustrated by way of the following examples, which should not be construed as limiting the present invention thereto.

Example 1

There was prepared a blue-sensitive silver iodobromide emulsion (containing 7 mole% of silver iodide) which contained, per mole of the silver halide, 300 g of gelatin, $2.5\times10^{-2}$ moles of $\alpha$-pivaloyl-$\alpha$-(1-benzyl-2,4-dioxyimidazoline-3-yl-2-chloro-5[$\gamma$-(2,4-tert-amylphenoxy)-butylamido]acetanilide as a yellow coupler, and 1,2-bis(vinylsulfonyl)ethane as a hardening agent. Two types of gelatin solutions were separately prepared which contained a dispersion A, the preparation of which will be described hereinafter, 1,2-bis(vinylsulfonyl)ethane, polymethylmethacrylate of an average particle size of $4\mu$ as a matting agent, and a coating aid. Thereafter, a cellulose triacetate film support which had been subbed was provided, onto which the halide silver emulsion and the two gelatin solutions were applied simultaneously by a slide hopper method using a coating speed of 50 m/min to form a silver halide photosensitive layer, a protective lower layer and a protective upper layer in this order as viewed from the support. The protective layers had the compositions shown in Table 1 below, respectively.

TABLE 1

Compositions of Protective Layers

| | | Sample No. 1 | 2 | 3 | 4 | 5 | 6 | 7 | 8 |
|---|---|---|---|---|---|---|---|---|---|
| Protective upper layer | Binder (gelatin) (g/m$^2$) | 3.2 | 2.7 | 2.4 | 2.0 | 0.8 | 0.7 | 0.50 | 0.8 |
| | Matting agent | Polymethylmethacrylate with an average particles size of $4\mu$, 0.02 g/m$^2$ | | | | | | | |
| | Oil content of dispersion A (g/m$^2$) | — | 0.38 | — | 0.28 | — | 0.1 | 0.28 | 0.03 |
| | Coating aid | Di-2-ethylhexylsulfosuccinic acid 0.001 g/m$^2$ | | | | | | | |
| Protective lower layer | Binder (gelatin) (g/m$^2$) | | | 0.8 | 0.7 | 2.4 | 2.0 | 2.2 | 1.90 |
| | Oil content of dispersion A (g/m$^2$) | (Note-1) | | — | 0.1 | — | 0.28 | 0.1 | 0.35 |
| | Coating aid | Saponin 0.05 g/m$^2$ | | | | | | | |
| Density of oil particles | Protective upper layer | 0 | 0.19 | 0 | 0.19 | 0 | 0.19 | 0.76 | 0.05 |

TABLE 1-continued

| Compositions of Protective Layers | | Sample No. | | | | | | | |
|---|---|---|---|---|---|---|---|---|---|
| | | 1 | 2 | 3 | 4 | 5 | 6 | 7 | 8 |
| (Note-2) | Protective lower layer | — | — | 0 | 0.19 | 0 | 0.19 | 0.06 | 0.25 |

Note-1:
The materials of Sample Nos. 1 and 2 were each provided with only one protective layer without including any other protective layer.
Note -2:
For calculating the oil particles density, the specific densities of gelatin and oil-soluble component were taken as 1.35 and 1.0, respectively.

The thickness of the protective layer was found to be 2.5μ for Sample Nos. 1 and 2, the thicknesses of the upper and lower layers were 1.8μ and 0.6μ, respectively, for Sample Nos. 3 and 4, and those of the upper and lower layers were 0.6μ and 1.8μ, respectively, for Sample Nos. 5, 6, 7 and 8.

With the materials of Sample Nos. 2, 4, 6, 7 and 8, the oil particles were contained in the protective layer or layers, and, in all the cases, the amount of the oil particles per unit area was controlled as same when calculated by adding the oil contents in the upper and lower layers.

Preparation of Dispersion A 24 g of dioctyl phthalate and 6 g of ethyl acetate were mixed at 65° C. The resulting solution was added with agitation to 100 cc of an aqueous 5% gelatin solution (50° C.) containing 1 g of sodium triisopropylnaphthalenesulfonate, followed by dispersing in a colloid mill five times to give the dispersion A.

After drying, Sample Nos. 1–8 were each cut to give two pieces with a size of 5 cm×5 cm. These test pieces were kept under conditions of 23° C. and 80% R.H. (the "R.H." means relative humidity herein) for one day in such a manner that they were free of contacting each other. Then, the pieces of the same sample were contacted such that the protective layers were facing each other, on which a load of 800 g was placed. The pieces were kept under conditions of 40° C. and 80% R.H., after which the weighed pieces were peeled off to check an area of adhered portions so as to determine the adhesion.

This tendency was evaluated as follows.

| Rank | Area of adhered portions |
|---|---|
| A | 0–20% |
| B | 21–40% |
| C | 41–60% |
| D | 61–80% |
| E | above 81% |

The sheets of Sample Nos. 1–8 were each cut to give a specimen of a size of 1×80 cm and kept under conditions of 23° C. and 20% R.H. for three days and then subjected to a brittleness test by a method using a wedge-shaped tester described in P.S.E., Vol. 1, page 63 (1957). The test results are expressed in terms of a length (mm) at which the test piece was broken, and a greater breaking length is determined as worse in brittleness. (The test results of brittleness will be expressed hereinafter in the same manner as indicated above).

Two test pieces (3.5×14 cm) of each of Sample Nos. 1–8 were each processed in the following manner without exposing to light and, after drying, one piece was kept under conditions of 70° C. and 80% R.H. for 3 days, which was subjected to a measurement of turbidity by the use of a turbidimeter. Higher value of turbidity results in a higher degree of perspiration.

| Developing Process (38° C.) | Processing time |
|---|---|
| Color development | 3 min. and 15 sec. |
| Bleaching | 6 min. and 30 sec. |
| Water washing | 3 min. and 15 sec. |
| Fixing | 6 min. and 30 sec. |
| Water washing | 3 min. and 15 sec. |
| Stabilizing bath | 1 min. and 30 sec. |

In the respective developing processes, the following processing compositions were used.

| | |
|---|---|
| Color developing solution: | |
| 4-Amino-3-methyl-N—ethyl-N—(β-hydroxyethyl)-aniline sulfate | 4.75 g |
| Anhydrous sodium sulfite | 4.25 g |
| Hydroxylamine (½ sulfate) | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.1 |
| Water to make up | |
| pH adjusted at 10.0 | |
| Bleaching solution: | |
| Iron ammonium (ethylenediaminetetraacetate) | 100.0 g |
| Diammonium (ethylenediaminetetraacetate) | 10.0 g |
| Ammonium bromide | 150.0 g |

The test pieces after the keeping and comparative samples which was not kept under the afore-indicated conditions after the processing were each subjected to a measurement using a turbidometer produced by Nippon Precision Engineering Co., Ltd., with the results shown in Table 2. T,0301.

By comparing the test results of Sample Nos. 1–6 in Table 2, it will be clear that the blocking (adhesion) tendency and brittleness are improved to a great extent with the case of Sample No. 6 of the invention though the amount of the matting agent per unit area are all in the same level.

Further, by comparing the results of Sample Nos. 6–8, it will be understood that Sample No. 8 in which the oil particle density in the protective upper layer was made smaller than that in the lower layer is more excellent in perspiration test.

If the content of the matting agent is increased in the case of Sample No. 1, the blocking tendency will be ranked up to A or B but such material will be undesirably increased in opacity with an increase of the amount of the matting agent and will be lowered in brittleness.

EXAMPLE 2

On a cellulose triacetate film support which had been subbed were formed a blue light-sensitive layer of the same type as in Example 1 and a protective lower layer and a protective upper layer with compositions shown in Table 3 in this order as viewed from the support by a slide hopper method in which the three layers were simultaneously applied at a coating speed of 80 m/min.

TABLE 3

| Compositions of Protective Layers | | Sample No. 9 | 10 | 11 | 12 | 13 | 14 |
|---|---|---|---|---|---|---|---|
| Protective upper layer | Binder | Gelatin 0.4 g/m$^2$ | | | Gelatin 2.3 g/m$^2$ | | |
| | Matting agent (0.04 g/m$^2$) | (A)* | (B) | (C) | (A) | (B) | (C) |
| | Coating aid | Sodium di-2-ethylhexyl-sulfosuccinate 0.01 g/m$^2$ | | | | | |
| Protective lower layer | Binder | Gelatin 1.9 g/m$^2$ | | | Gelatin 0.3 g/m$^2$ | | |
| | Oil content of dispersion A | 15 g per 100 g of the binder contained in this lower layer. | | | | | |
| | Coating aid | Saponin 0.05 g/m$^2$ | | | | | |

(Note)
*Matting agent (A): poly(methylmethacrylate) with an average particle size of 0.5μ.
Matting agent (B): poly(methylmethacrylate) with an average particle size of 2μ.
Matting agent (C): poly(methylmethacrylate) with an average particle size of 5μ.

The specimens of Sample Nos. 9–11 had a thickness of the upper layer of 0.3μ and that of the lower layer of about 1.7μ, and the specimens of Sample Nos. 12–14 had thicknesses of the upper and lower layers of 1.7μ and 0.3μ, respectively.

The specimens of Sample Nos. 9–14 obtained after drying were subjected to the evaluation tests for blocking tendency and brittleness by the same methods as used in Example 1.

TABLE 4

| Test Results | Sample No. 9 | 10 | 11 | 12 | 13 | 14 |
|---|---|---|---|---|---|---|
| Evaluation on blocking test | D | B | A | E | E | D |
| Brittleness test (breaking length) | 22 | 24 | 25 | 23 | 26 | 27 |

The specimens of Sample Nos. 10 and 11 according to the invention will be understood to be excellent in blocking tendency and brittleness.

EXAMPLE 3

A subbed cellulose triacetate film base was provided thereon with the following layers in the order described.

First Layer

Anti-halation layer containing black colloidal silver (with a dry thickness of 1μ).

Second Layer

Red light-sensitive silver bromoiodide layer (formed from a silver bromoiodide emulsion containing 8 mole% of silver bromide in a dry film thickness of 6μ) containing, per mole of the silver halide, $6.8\times10^{-2}$ moles of 1-hydroxy-N-[γ-(2,4-di-tert-amylphenoxy)-butyl]-2-naphthoamide as a cyan coupler, $1.7\times10^{-2}$ moles of 1-hydroxy-N-[γ-(2,4-di-tert-amylphenoxy)-butyl]-4-(2-ethoxycarbonylphenylazo)-2-naphthoamide as a colored coupler, and $4\times10^{-3}$ moles of 2-(1-phenyl-5-tetrazolylthio)-4-(2,4-di-tert-amylphenoxyacetoamido)-1-indanone as a development inhibitor-releasing substance.

Third Layer

Silver bromoiodide photosensitive layer of low green sensitivity (formed from a silver bromoiodide emulsion containing 8 mole% of silver iodide in a dry film thickness of 3.5μ) containing, per mole of the silver halide, $5.8\times10^{-2}$ moles of 1-(2,4,6-trichloro)phenyl-3-[3-(2,4-di-tert-amylphenoxy)acetoamido]benzamido-5-pyrazolone as a magenta coupler, $1.7\times10^{-2}$ moles of 1-(2,4,6-trichlorophenyl)-3-[3-(octadecenylsuccinimido)-2-chloro]anilido-4-(γ-naphthylazo)-5-pyrazolone as a colored coupler, and $7\times10^{-3}$ moles of 2-(1-phenyl-5-tetrazolylthio)-4-(2,4-di-tert-amylphenoxyacetoamido)-1-indanone as a development inhibitor-releasing substance.

Fourth Layer

Silver bromoiodide photosensitive layer of high green sensitivity (formed from a silver bromoiodide emulsion containing 6 mole% silver iodide in a dry thickness of 2.5μ) containing, per mole of the silver halide, $1.1\times10^{-2}$ moles, $5\times10^{-3}$ moles and $2\times10^{-2}$ moles of the magenta coupler, colored coupler and development inhibitor-releasing substance of the third layer, respectively.

Fifth Layer

Gelatin layer (with a dry thickness of 1μ) containing yellow colloidal silver and 2,5-di-tert-octylhydroquinone.

Sixth Layer

Blue light-sensitive silver bromoiodide photosensitive layer (formed from a silver bromoiodide emulsion containing 7 mole% of silver iodide in a dry thickness of 6μ) containing, per mole of the silver halide, 350 g of gelatin, and α-pyvaloyl-α-(1-benzyl-2-phenyl-3,5-dioxotriazolidin-4-yl)-5′-[α-(2,4-di-tert-amylphenoxy)-butylamido]-2′-chloroacetoanilide as a yellow coupler and 1,2-bis(vinylsulfonyl)ethane as a hardening agent.

Further, protective layers of the following formulations were formed on the sixth layer as seventh and eighth layers.

TABLE 5

| Compositions of Seventh and Eighth Protective Layers | | Sample No. 15 | 16 | 17 | 18 | 19 |
|---|---|---|---|---|---|---|
| Protective upper layer | Binder | Gelatin 0.65 g/m$^2$ | | | | |
| | Matting agent | Silica with an average particle size of 5μ 0.02 g/m$^2$ | | | | |
| | Slipping agent (1) | 0.04 g/m$^2$ | | | | |
| | Organic fluoro compound (compound No. 23 indicated hereinbefore) | 5 mg/m$^2$ | | | | |
| | Coating aid | Sodium di-2-ethyl-hexylsulfosuccinate 0.01 g/m$^2$ | | | | |
| Protective lower | Binder | Gelatin 1.6 g/m$^2$ | | | | |
| | Dispersion A | 0.32 g/m$^2$ | | | | |
| | Dispersion B | | | | 0.32 g/m$^2$ | |

TABLE 5-continued

| Compositions of Seventh and Eighth Protective Layers | | Sample No. | | | | |
|---|---|---|---|---|---|---|
| | | 15 | 16 | 17 | 18 | 19 |
| layer | Coating aid | Saponin 0.03 g/m$^2$ | | | | |

(Note)
Slipping agent (1):

$$\begin{array}{l} CH_2{-}OOC{-}nC_{11}H_{23} \\ | \\ CH{-}OOC{-}nC_{11}H_{23} \\ | \\ CH_2{-}OOC{-}nC_{11}H_{23} \end{array}$$

After drying, the thickness of the protective upper layer was found to be about 0.5μ in all the cases and that of the protective lower layer was about 1.2μ for Sample No. 15 and about 1.5μ for Sample Nos. 16–19.

Dispersion B 9 g Of a mixture of compounds (A), (B), (C) and (D) (ultraviolet absorber) expressed by the following structural formulae (mixing ratios: Compound (A) Compound (B) Compound (C) Compound (D)=2:1:1:1) was dissolved in 15 g of dioctyl phthalate and 6 g of ethyl acetate at 65° C., which was added, with agitation, in 100 cc of an aqueous 5% gelatin solution (50° C.) containing 1 g of sodium triisopropylnaphthalenesulfonate, followed by dispersing five times in a colloid mill to give a dispersion B.

Compound (A)

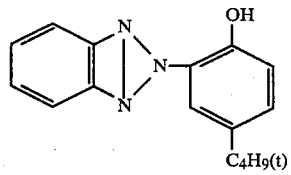

Compound (B)

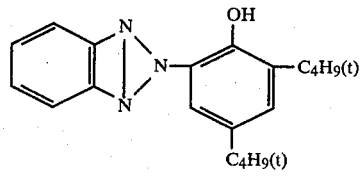

Compound (C)

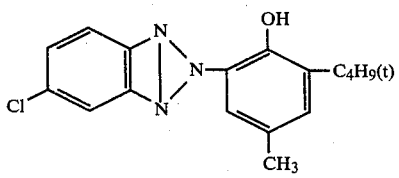

Compound (D)

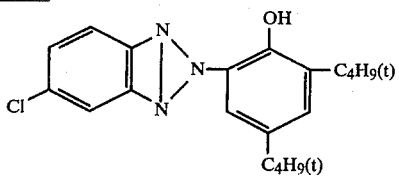

It will be noted that all of the compounds (A), (B), (C) and (D) are commercially available under the names of "Tinubin PS", "Tinubin 320", "Tinubin 326" and "Tinubin 327" from Ciba-Geigy A.G.

After drying, Sample Nos. 15–19 were each cut to give two pieces with a size of 5×5 cm and kept under conditions of 23° C. and 80% R.H. for 1 day. Thereafter, the test pieces of the same kind were contacted such that the protective layers were facing each other, on which load of 800 g was placed, followed by keeping under conditions of 40° C. and 80% R.H. Then, the test pieces were peeled to determine the blocking tendency according to the standard indicated in Example 1.

The samples were each separately cut to have a width of 35 mm and each sample of about 1 m long was perforated and kept under conditions of 23° C.–20% R.H. for 1 day, followed by determining the breaking length similarly to the case of Example 1 using a wedge-shaped tester.

Further, the samples of Nos. 15–19 were subjected to a measurement of kinetic friction coefficient against photographic light-shielding paper in accordance with a method as prescribed in ASTM D-1814.

TABLE 6

| | Sample No. | | | | |
|---|---|---|---|---|---|
| | 15 | 16 | 17 | 18 | 19 |
| Evaluation on blocking tendency | B | B | B | A | A |
| Brittleness test (breaking length mm) | 78 | 40 | 36 | 38 | 38 |
| Kinetic friction coefficient | 0.65 | 0.63 | 0.36 | 0.34 | 0.35 |

From the results of Table 6 it will be clear that the samples according to the invention (i.e. Samples of Nos. 16–19) are remarkably improved in brittleness in spite of a fact that the amount of the matting agent per unit area and the thickness of the protective upper layer are the same as that of Sample No. 15.

It will be further seen that the addition of the organic fluoro compound contributes to improve the blocking tendency (see Sample Nos. 18 and 19) and that the addition of the slipping agent is effective in lowering the kinetic friction coefficient.

What we claim is:

1. A silver halide photosensitive material comprising a support, and a silver halide photosensitive layer and a protective layer formed on said support in this order, the protective layer being essentially composed of a plurality of non-photosensitive hydrophilic colloidal layers at least one of which contains oil particles, the outermost layer of the hydrophilic colloidal layers containing a matting agent in the form of colloidal particles and having a thickness not more than ¼ times an average size of the matting agent particles and wherein the density of the oil particles in the outermost layer is the range not exceeding 0.2 by volume of the binder, and that of the oil particles in the protective layers other than the outermost layer is in the range of 0.1–0.8.

2. A silver halide photosensitive material according to claim 1, wherein said matting agent is polymethacrylate or silica and has an average particle size of 1 to 8μ.

3. A silver halide photosensitive material according to claim 1, wherein the outermost layer is not more than 1μ in thickness.

4. A silver halide photosensitive material according to claim 1, wherein the density of the oil particles in the outermost layer is not the highest among the oil particle densities of the other hydrophilic colloidal layer or layers.

5. A silver halide photosensitive material according to claim 1, wherein the oil particles in the outermost layer comprises a slipping agent as its principal component.

6. A silver halide photosensitive material according to claim 1, wherein at least one of the hydrophilic colloidal layers comprises an organic fluoro compound.

7. A silver halide photosensitive material according to claim 6, wherein said organic fluoro compound is contained in an amount of 0.1–500 mg per $m^2$ of the at least one layer.

* * * * *